US008653949B2

(12) United States Patent
Lee et al.

(10) Patent No.: US 8,653,949 B2
(45) Date of Patent: Feb. 18, 2014

(54) INTELLECTUAL REFRIGERATOR COMBINING WITH PORTABLE ELECTRIC DEVICE AND CONTROL METHOD FOR THE SAME

(76) Inventors: Cheng-Tzong Lee, Pingzhen (TW); Fu-Cheng Pan, Taipei (TW)

( * ) Notice: Subject to any disclaimer, the term of this patent is extended or adjusted under 35 U.S.C. 154(b) by 648 days.

(21) Appl. No.: 12/964,888

(22) Filed: Dec. 10, 2010

(65) Prior Publication Data

US 2012/0144847 A1 Jun. 14, 2012

(51) Int. Cl.
*G06F 1/00* (2006.01)

(52) U.S. Cl.
USPC ..... 340/12.22; 340/3.7; 62/125

(58) Field of Classification Search
CPC .. G06F 1/1601; F25D 27/005; F25D 2400/36
USPC ..... 340/12.22, 3.1, 3.7, 3.71; 62/125, 126
See application file for complete search history.

(56) References Cited

U.S. PATENT DOCUMENTS

2003/0103023 A1* 6/2003 Ootsuka et al. ..... 345/87
2004/0154318 A1* 8/2004 Roh et al. ..... 62/126
2006/0174641 A1* 8/2006 Liu et al. ..... 62/246
2008/0192411 A1* 8/2008 McCoy ..... 361/679
2009/0277199 A1* 11/2009 Manas et al. ..... 62/129

FOREIGN PATENT DOCUMENTS

CN 101202935 A 6/2008

* cited by examiner

*Primary Examiner* — Edwin Holloway, III
(74) *Attorney, Agent, or Firm* — Chun-Ming Shih; HDLS IPR Services

(57) ABSTRACT

An intellectual refrigerator combining with a portable electric device is present. The refrigerator has an image unit, a wireless transmitting unit and a micro control unit (MCU) therein. The image unit is used to monitor status or fetch image in a case of the refrigerator. The MCU electrically connects to the image unit and the wireless transmitting unit. The refrigerator further includes a connecting socket arranged on an outer surface of the case, and the connecting socket includes a first transmitting interface electrically connected to the MCU. When the electric device is plugged in the connecting socket, a connection is established by the MCU of the refrigerator with the electric device physically via the first connecting interface. When the electric device is removed from the connection socket, the connection is automatically turned to establish by the MCU with the electric device wirelessly via the wireless transmitting unit.

6 Claims, 4 Drawing Sheets

INTELLECTUAL REFRIGERATOR COMBINING WITH PORTABLE ELECTRIC DEVICE AND CONTROL METHOD FOR THE SAME

BACKGROUND OF THE INVENTION

1. Field of the Invention

The invention related to a refrigerator, and in particular to an intellectual refrigerator which can be used in combination with an electric device.

2. Description of Prior Art

Refrigerator is a cooling electric device for storing and freezing food. Aspect to practicality and convenience of refrigerator, it is used now very commonly and generally in anywhere.

However, following the progress of technology and the develop step of electronic industry, there are now many kinds of intellectual refrigerator are produced to product in market.

For example, the Taiwan utility model M364197 disclosed an intellectual refrigerator using RFID. Such refrigerator includes a plurality of electric tags arranged on an outer surface of a container, an identifier for reading/writing digital information from the electric tags, and a human machine interface (HMI) connected to the identifier. The refrigerator further includes a monitor and a keyboard on an outer surface of the refrigerator, the monitor is used to display information about the container, and the keyboard is used to write information into the electric tags.

As mentioned above, such refrigerator should arrange the monitor and the keyboard on the outer surface and connect them with the identifier and the HMI when the refrigerator is producing to product. Therefore, the cost of the refrigerator is increased, and the increased cost is just the main reason why customers have low desire for purchasing the intellectual refrigerator.

For another example, the China patent CN101202935 disclosed a method for remotely controlling and monitoring a refrigerator and an intellectual refrigerator for the same. The method first arranges a communication device on the refrigerator which can communicate with a personal communication terminal, and then, fetches physical parameters in the refrigerator and transmits it to the personal communication terminal to display. Finally, user can control the refrigerator remotely by sending signal through the personal communication terminal.

However, above-mentioned method transmits data via communication network such as global system of mobile communications (GSM) or general packet radio service (GPRS). The method has several disadvantages, for example, slow transmitting rate and high transmitting fee.

Furthermore, the method still transmits data between the refrigerator and the personal communication terminal via communication network even the user is approached the refrigerator, and it will cause unnecessary waste and unpracticality.

SUMMARY OF THE INVENTION

The invention is to provide an intellectual refrigerator combining with a portable electric device and control method for the same. The inside status of the intellectual refrigerator can be monitored through the electric device, and the communication type between the intellectual refrigerator and the electric device can be switched automatically according to the usage of user.

According to the present invention, the intellectual refrigerator has an image unit, a wireless transmitting unit and a micro control unit (MCU) therein. The image unit is used to monitor or fetch image inside a case of the refrigerator. The MCU connects to the image unit and the wireless transmitting unit.

The refrigerator further includes a connecting socket arranged on an outer surface of the case, and the connecting socket includes a first transmitting interface electrically connected to the MCU.

When the electric device is plugged in the connecting socket, a connection is established by the MCU of the refrigerator with the electric device physically via the first connecting interface. When the electric device is removed from the connecting socket, the connection is automatically turned to establish by the MCU with the electric device wirelessly via the wireless transmitting unit.

In comparison with prior art, the present invention has advantageous features as follow. The intellectual refrigerator senses the status therein by using inside sensors and then presents to the user through the electric device. By way of the motion of image unit and lighting unit in the intellectual refrigerator, user can also monitor inside image of the intellectual refrigerator on a monitor of the electric device.

Therefore, user can fetch whole information about the intellectual refrigerator without opening the door of the intellectual refrigerator. Further, the electric device can be plugged in the socket arranged on the outer surface of the case for being a monitor and controller of the intellectual refrigerator. The present invention can also reduce the product cost of the intellectual refrigerator.

Furthermore, respecting to the usage of the user, the electric device can be removed from the socket of the intellectual refrigerator at anytime, and then the electric device can be used as a wireless controller of the intellectual refrigerator, and the usage type of this present invention is more diversified.

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
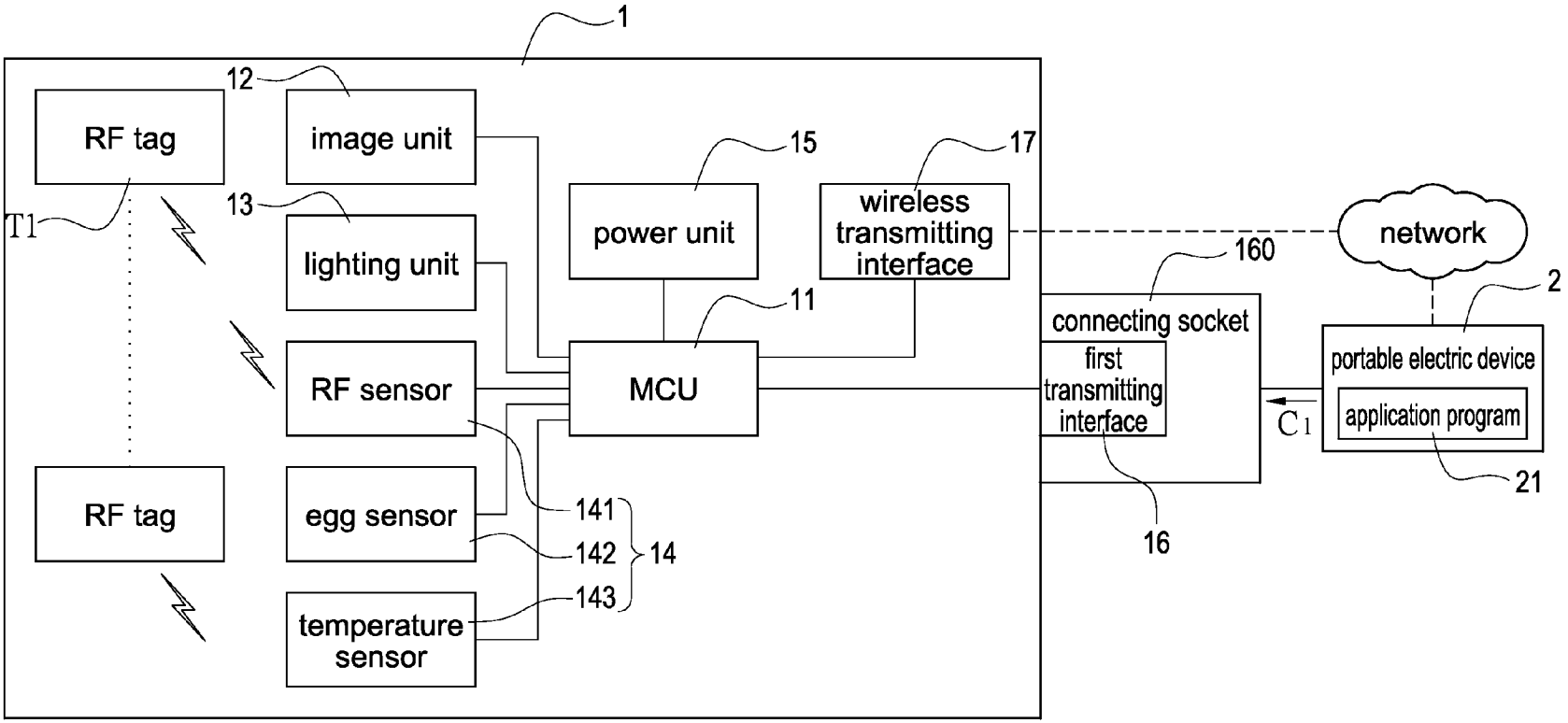
FIG. 1 is a block view of a preferred embodiment according to the present invention.

FIG. 1 is a block view of a preferred embodiment according to the present invention. The intellectual refrigerator 1 (referred to as the refrigerator 1 thereinafter) of this invention is mainly controlled in combination with a portable electric device 2 (referred to as the electric device 2 thereinafter).

The refrigerator 1 has an image unit 12, a lighting unit 13, a plurality of sensors 14 and a micro control unit (MCU) 11 electrically connected to the image unit 12, the lighting unit 13 and each of the plurality of sensors 14.

The image unit 12 is triggered to turn on by the MCU 11, and the image unit 12 is used to monitor a status in a case 10 (shown in FIG. 2) of the refrigerator 1, or to fetch an inside image of the case 10. The lighting unit 13 is, for example, an electric light arranged in the case 10, and is triggered to turn on lighting when the door of the refrigerator 1 is opened. Further, the lighting unit 13 can also be turned on by the MCU 11 when the image unit 12 is monitoring or fetching, therefore, the lighting unit 13 can compensate the light in the case 10 for the image unit 12.

Each of the plurality of sensors 14 comprises a Radio Frequency (RF) sensor 141, an egg sensor 142 and a temperature sensor 143, but any type of sensors which can be used to sense the status in the case 10 can apply to the refrigerator 1 of this invention, not intended to limit the protection scope of present invention.

The RF sensor 141 is used to sense RF tags T1 in the case 10 and read digital information from the RF tags T1. The egg sensor 142 is used to sense an amount of eggs in the refrigerator 1. The temperature sensor 143 is used to sense a temperature state in the refrigerator 1.

The refrigerator 1 further comprises a power unit 15, which is electrically connected to the MCU 11. The power unit 15 is used to connect to an outer Alternating Current (AC) source, so as to provide electric power to the refrigerator 1.

The refrigerator 1 further includes a connecting socket 160 arranged on an outer surface of the case 10, and the connecting socket 160 includes a first transmitting interface 16 electrically connected to the MCU 11. The refrigerator 1 further includes a wireless transmitting unit 17 electrically connected to the MCU 11 therein.

The first transmitting interface 16 can be a universal serial bus (USB) transmitting interface, and the wireless transmitting interface 17 can be a Bluetooth transmitting interface, a third Generation (3G) transmitting interface or a wireless fidelity (Wi-Fi) transmitting interface for example, but not intended to limit the scope of the present invention.

The electric device 2 can mainly connect with the refrigerator 1 physically via the first transmitting interface 16, or connect with the refrigerator 1 wirelessly via the wireless transmitting interface 17.

The electric device 2 installs an application program 21 therein. When the application program 21 is executed, the electric device 2 connects to the refrigerator 1 via the first transmitting interface 16 or the wireless transmitting interface 17, so as to transmit a control command C1 to the refrigerator 1, and to receive data transmitted from the MCU 11 of the refrigerator 1.

Wherein, the data transmitted from the MCU 11 can be, for example, monitoring frame or fetched image producing by the image unit 12, or sensing information sensed by the plurality of sensors 14.

Figure 2:
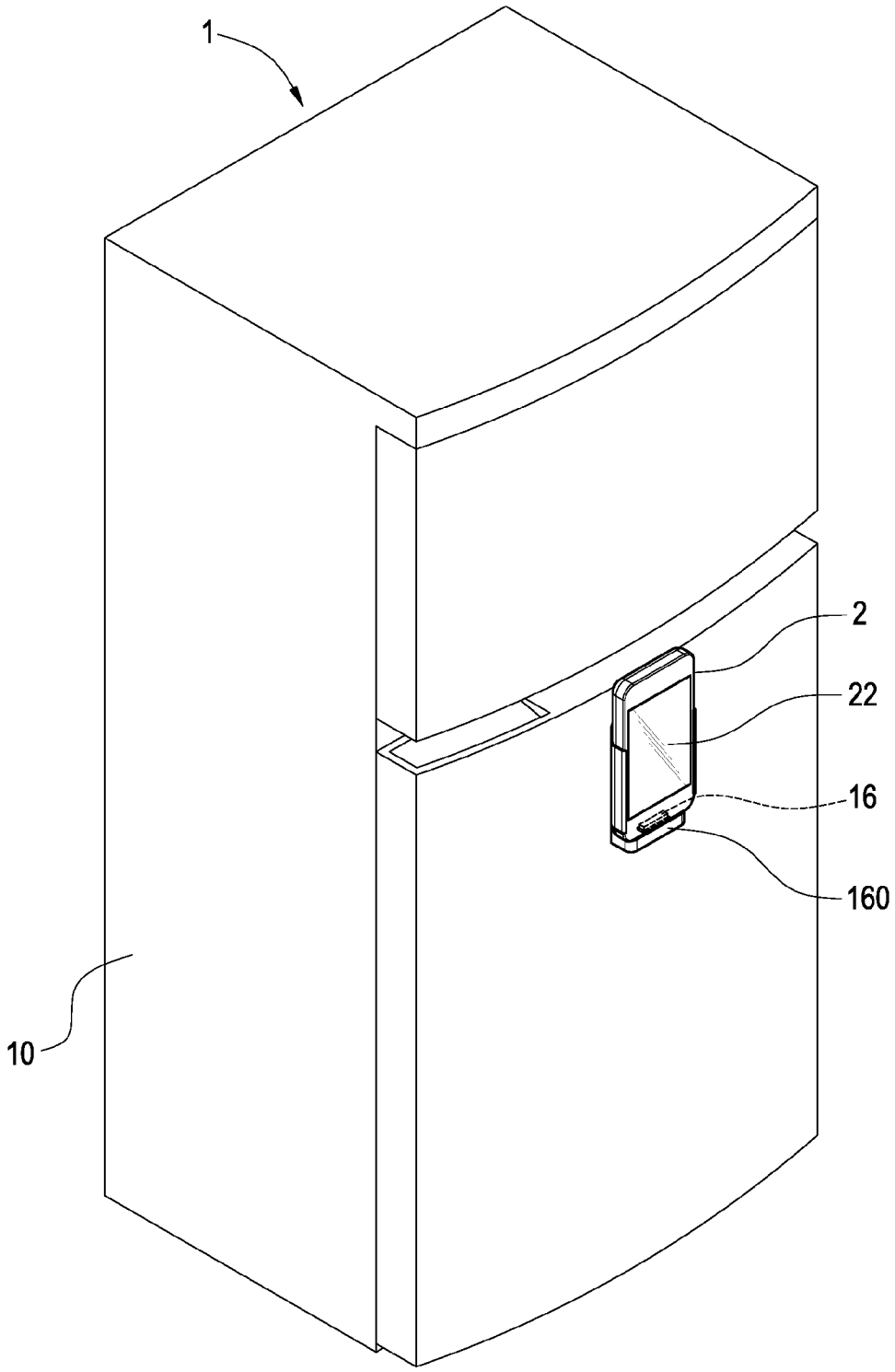
FIG. 2 is a perspective view of a preferred embodiment according to the present invention.
Figure 3:
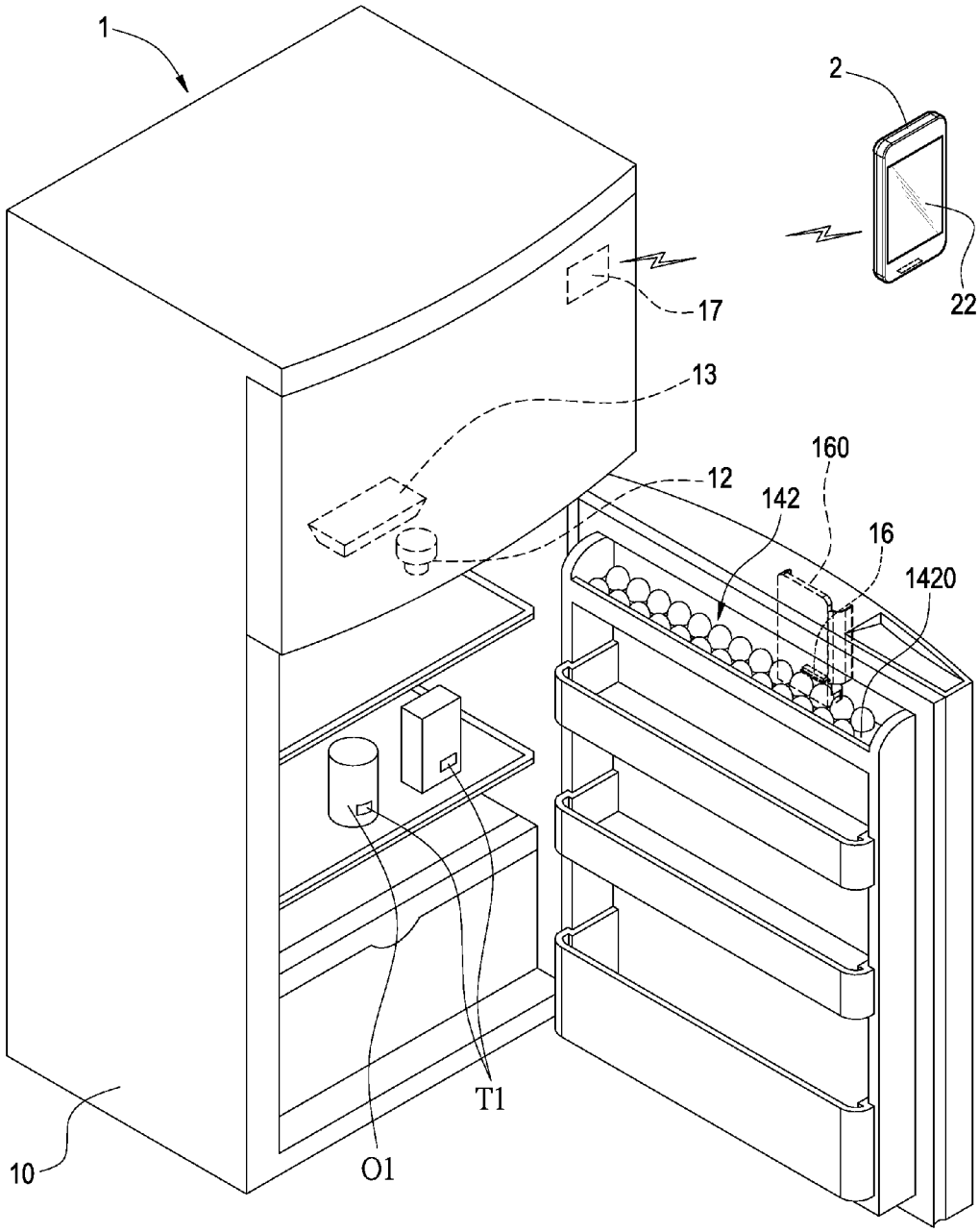
FIG. 3 is a perspective view of a second embodiment according to the present invention.

FIG. 2 is a perspective view of a preferred embodiment according to the present invention, and FIG. 3 is a perspective view of a second embodiment according to the present invention.

The connecting socket 160 is arranged on the outer surface of the case 10, when the electric device 2 is plugged in the connecting socket 160, it is electrically connected to the first transmitting interface 16. Therefore, a connection is established by the MCU 11 of the refrigerator 1 with the electric device 2 physically (namely, wiredly) via the first transmitting interface 16, so as to transmit the control command C1 and the data physically between the refrigerator 1 and the electric device 2.

Further, the electric device 2 can set up and stand on the connecting socket 160 directly, thus a monitor 22 of the electric device 2 can be used as a monitor of the refrigerator 1. Moreover, the electric device 2 can be, for example, an intellectual mobile phone, a Personal Digital Assistant (PDA), or a tablet computer such as iPad, but not intended to limit the protection scope of the present invention.

It should be noticed that, when the electric device 2 is plugged in the connecting socket 160, the electric device 2 can receive electric power for charging from the power unit 15 through the first transmitting interface 16 and the MCU 11.

When the electric device 2 is removed from the connecting socket 160, the connection is automatically turned to establish by the MCU 11 of the refrigerator 1 with the electric device 2 wirelessly via the wireless transmitting unit 17. Therefore, the control command C1 and the data are transmitted between the refrigerator 1 and the electric device 2 wirelessly.

As mentioned above, user can send the control command C1 to the refrigerator 1 for triggering the image unit 12 and the lighting unit 13 by pressing a button (not shown) on the electric device 2 or the monitor 22 which is touchable. Therefore, the image unit 12 monitors the status in the case 10 of the refrigerator 1 according to the control command C1, and monitoring frames produced by the image unit 12 are then transmitted to display on the monitor 22 of the electric device 2.

Further, user can also use the electric device 2 to control the image unit 2 to fetch inside images of the refrigerator 1 by taking photographs or making video recordings, and the fetched images are then transmitted to the electric device 2 to play on the monitor 22.

Also, user can control the image unit 12 to move, such as adjusting the angle of camera or rooming in/out via the control command C1. It can then produce preferred monitoring frames or fetched images for user.

More particularly, the image unit 12 can be, for example, a Chare Couple Device (CCD) or a Complementary Metal-Oxide Semiconductor (COMS), but not intended to limit the protection scope of the present invention.

User can control the action of the plurality of sensors 14 via the control command C1.

The case 10 includes at least one content article O1 (such as packaged food or beverage) therein. The RF tag T1 is arranged on an outside package of the content article O1, and the RF tag T1 records digital information about the content article O1 therein, such as article's name, contents and valid date of the content article O1, but not intended to limit the protection scope of the present invention.

The RF sensor 141 produces the digital information after sensing the RF tag T1 of the content article O1, and then transmits the digital information to the MCU 11, and the MCU 11 transmits the received digital information to the electric device 2 via the first transmitting interface 16 or the wireless transmitting interface 17.

The case 10 has an egg box 1420 therein, and the egg sensor 142 is set in the egg box 1420 for sensing the amount of eggs in the egg box 1420. After sensing, the egg sensor 142 transmits the data of the amount to the MCU 11, and the MCU 11 transmits the received data to the electric device 2 via the first transmitting interface 16 or the wireless transmitting interface 17.

More particularly, the egg sensor 142 can be, for example but not to limited, a pressure resistance, a panel switch or an Infrared Ray (IR) sensor.

As mentioned above, user can monitor the status in the case 10 or fetch inside images of the case 10 through the electric device 2 without opening the door of the refrigerator 1, and the user can also receive the data such as the amount of eggs, the contents, the valid date and decoration of the content article O1 and in the case 10. Therefore, the present invention can be used for saving electric power and satisfying purpose of environmental protection.

Figure 4:
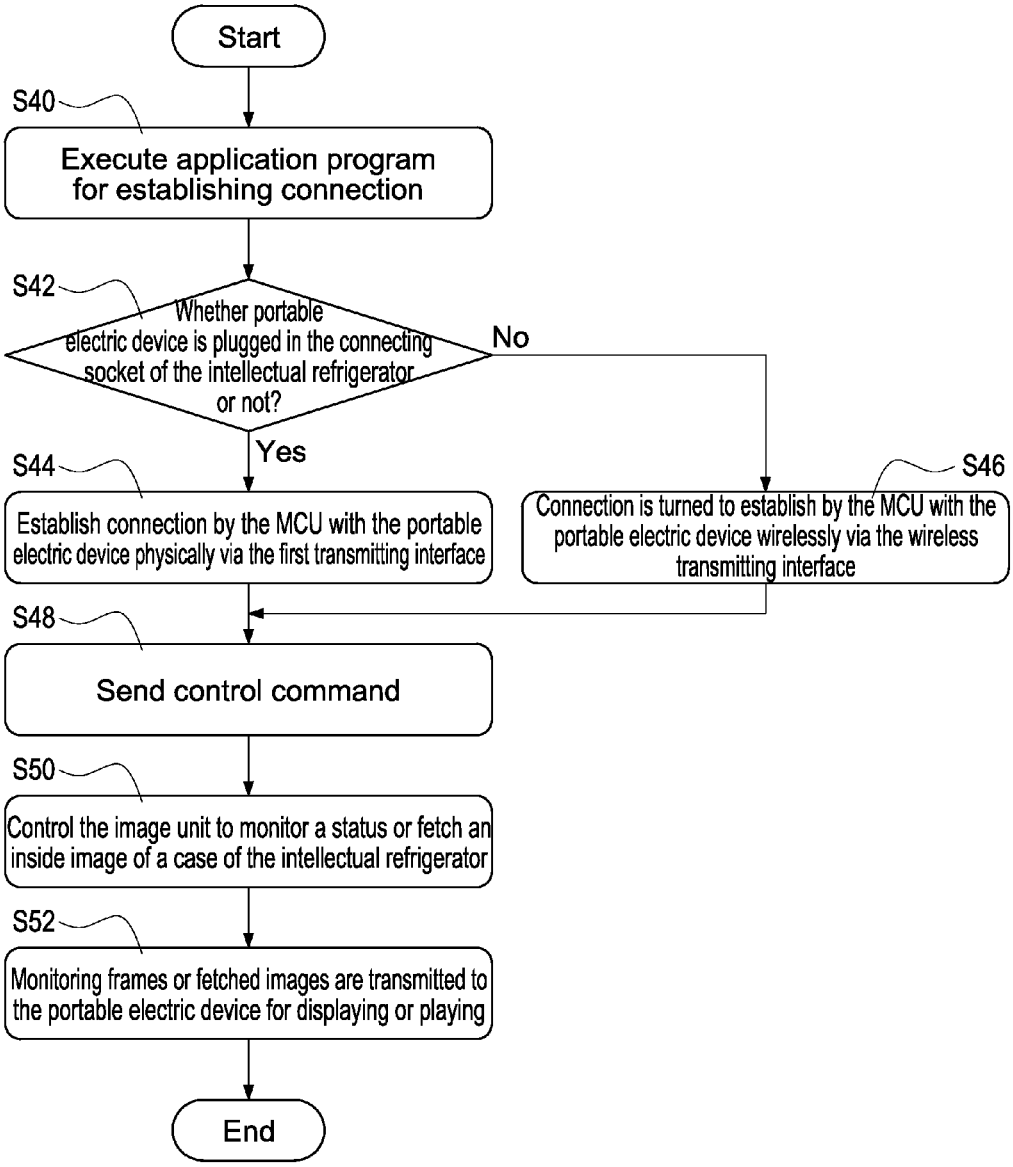
FIG. 4 is a flow chart of a preferred embodiment according to the present invention.

FIG. 4 is a flow chart of a preferred embodiment according to the present invention.

First, the application program 21 of the electric device 2 is executed for connecting the electric device 2 with the refrigerator 1 (step S40). Then, the refrigerator 1 determines whether the electric device 2 is plugged in the connecting socket 160 or not by the MCU 11 (step S42).

Following the step S42, if yes, a connection is established by the MCU 11 of the refrigerator 1 with the electric device 2 physically via the first transmitting interface 16 (step S44). Following the step S42, if not, the connection is automatically turned to establish by the MCU 11 of the refrigerator 1 with the electric device 2 wirelessly via the wireless transmitting unit 17 (step S46).

When the electric device 2 connects with the refrigerator 1 successfully, regardless of physically or wirelessly, the electric device 2 can send the control command C1 to the refrigerator 1 via the application program 21 (step S48). After receiving the control command C1, the MCU 11 controls the image unit 12 to monitor the status in the refrigerator 1 or to fetch the inside image of the refrigerator 1 according to the content of the control command C1 (step S50).

Finally, the refrigerator 1 transmits the monitoring frames or the fetched images to the electric device 2, and displays or plays it on the monitor 22 (step S52). It should be noticed that the lighting unit 13 is triggered to turn on by the MCU 11 at the same time the image unit 12 is monitoring or fetching. Therefore, the lighting unit 13 can compensate the light for the image unit 12 in the case 10 of the refrigerator 1.

Moreover, the electric device 2 can also control the image unit 12 to move, such as moving the angle of the camera or rooming in/out, via the control command C1.

Therefore, the image unit 12 can produce preferred monitoring frame or fetched image for user.

As the skilled person will appreciate, various changes and modifications can be made to the described embodiment. It is intended to include all such variations, modifications and equivalents which fall within the scope of the present invention, as defined in the accompanying claims.

What is claimed is:

1. An intellectual refrigerator system comprising:

a portable electric device; and a refrigerator combining with the portable electric device, the portable electric device installed an application program therein, and the portable electric device being connected with the refrigerator via the application program, the refrigerator comprising:

a micro control unit (MCU);

an image unit electrically connected to the MCU, being triggered to turn on by the MCU for monitoring a status in a case of the refrigerator to display monitoring frames on a monitor of the portable electric device, or fetching an inside image of the case of the refrigerator to the portable electric device for displaying on the monitor;

a lighting unit electrically connected to the MCU, being triggered to turn on by the MCU when the image unit is monitoring or fetching;

a plurality of sensors electrically connected to the MCU separately, wherein each sensor is triggered to turn on by the MCU for sensing the status in the case of the refrigerator;

at least one content article having a Radio Frequency (RF) tag therein, and the plurality of sensors comprising an RF sensor for sensing digital information from the RF tag arranged on the content article, a temperature sensor for sensing temperature state in the case of the refrigerator, and an egg sensor set in an egg box for sensing an amount of eggs in the egg box, wherein the egg sensor is a pressure resistance or an Infrared Ray (IR) sensor;

a wireless transmitting interface electrically connected to the MCU; and a connecting socket arranged on an outer surface of the case, the connecting socket including a first transmitting interface which is electrically connected to the MCU;

wherein, when plugging in the connecting socket, the portable electric device is electrically connected to the first transmitting interface and a connection is established by the MCU of the refrigerator with the portable electric device physically via the first transmitting interface, and when the portable electric device is removed from the connecting socket, the connection is turned to establish by the MCU with the portable electric device wirelessly via the wireless transmitting interface, thereby the portable electric device transmits a control command to the MCU and receives data from the MCU to control operations of the image unit, the lighting unit, the RF tag, the RF sensor, the temperature sensor and the egg sensor through the application program.

2. The intellectual refrigerator system of claim 1, wherein the first transmitting interface is an universal serial bus (USB) transmitting interface.

3. The intellectual refrigerator system of claim 2, wherein the refrigerator further comprises a power unit electrically connected to the MCU, the power unit connects to an outer alternating current (AC) for providing electric power to the refrigerator, and charges the portable electric device when the portable electric device is plugged in the connecting socket.

4. The intellectual refrigerator system of claim 2, wherein the wireless transmitting interface is a bluetooth transmitting interface, a third generation (3G) transmitting interface or a wireless fidelity (Wi-Fi) transmitting interface.

5. The intellectual refrigerator system of claim 4, wherein the image unit is a Charge Couple Device (CCD) or a Complementary Metal-Oxide-Semiconductor (COMS).

6. A controlling method of an intellectual refrigerator system comprising:

providing a refrigerator and a portable electric device of the intellectual refrigerator system, the refrigerator including:

a micro control unit (MCU);

an image unit electrically connected to the MCU, being triggered to turn on by the MCU for monitoring a status in a case of the refrigerator to display monitoring frames on a monitor of the portable electric device, or fetching an inside image of the case of the refrigerator to the portable electric device for displaying on the monitor;

a lighting unit electrically connected to the MCU, being triggered to turn on by the MCU when the image unit is monitoring or fetching;

a plurality of sensors electrically connected to the MCU separately, wherein each sensor is triggered to turn on by the MCU for sensing the status in the case of the refrigerator;

at least one content article having a Radio Frequency (RF) tag therein, and the plurality of sensors comprising an RF sensor for sensing digital information from the RF tag arranged on the content article, a temperature sensor for sensing temperature state in the case of the refrigerator, and an egg sensor set in an egg box for sensing an amount of eggs in the egg box, wherein the egg sensor is a pressure resistance or an Infrared Ray (IR) sensor;

a wireless transmitting interface electrically connected to the MCU therein; and a connecting socket arranged on an outer surface of a case of the refrigerator, the connecting socket including a first transmitting interface electrically connected to the MCU;

executing an application program of the portable electric device for connecting the portable electric device with the refrigerator;

determining whether the portable electric device is plugged in the connecting socket or not;

establishing connection by the MCU of the refrigerator with the portable electric device physically via the first transmitting interface if the portable electric device is plugged in the connecting socket;

establishing connection by the MCU of the refrigerator with the portable electric device wirelessly via the wireless transmitting interface if the portable electric device is not plugged in the connecting socket; and transmitting a control command to the MCU and receiving data from the MCU by the portable electric device so as to control operations of the image unit, the lighting unit, the RF tag, the RF sensor, the temperature sensor and the egg sensor through the application program.

* * * * *